United States Patent [19]

McGinnis

[11] Patent Number: 5,059,300

[45] Date of Patent: Oct. 22, 1991

[54] ASPHALTS MODIFIED BY SOLVENT DEASPHALTED BOTTOMS AND PHOSPHORIC ACID

[75] Inventor: Edgar L. McGinnis, Moraga, Calif.

[73] Assignee: Chevron Research and Technology Company, San Francisco, Calif.

[21] Appl. No.: 246,565

[22] Filed: Sep. 19, 1988

Related U.S. Application Data

[63] Continuation of Ser. No. 948,211, Dec. 31, 1986, abandoned.

[51] Int. Cl.[5] ..... C10G 1/20

[52] U.S. Cl. ..... 208/44; 208/4; 208/6; 208/22; 208/39; 106/273.1

[58] Field of Search ..... 208/4, 6, 22, 39, 44; 106/273.1

[56] References Cited

U.S. PATENT DOCUMENTS

| | | | |
|---|---|---|---|
| 2,179,208 | 11/1939 | Burk et al. | 208/4 |
| 2,676,910 | 4/1954 | Edson | 106/273.1 |
| 2,762,756 | 9/1956 | Kinnard, Jr. | 208/4 |
| 3,392,104 | 7/1968 | Potts et al. | 208/4 |
| 3,751,278 | 8/1973 | Alexander | 208/22 |
| 4,584,023 | 4/1986 | Goodrich | 106/273.1 |
| 4,623,395 | 11/1986 | Goodrich | 106/273.1 |

*Primary Examiner*—Helane E. Myers

*Attorney, Agent, or Firm*—R. C. Gaffney; J. J. DeYoung

[57] ABSTRACT

Disclosed is a method for modifying the physical properties of a bituminous material which comprises heating at an elevated temperature a mixture comprising:

(a) 0.1 to 20.0 percent by weight phosphoric acid;

(b) 1 to 15 percent by weight solvent deasphalted bottoms; and (c) a bituminous material to make up 100 percent by weight, said bituminous material comprising vacuum distilled asphalt.

9 Claims, 1 Drawing Sheet

SOFTENING POINT AND PENETRATION RANGES OF INDUSTRIAL ASPHALT GRADES

ASPHALTS MODIFIED BY SOLVENT DEASPHALTED BOTTOMS AND PHOSPHORIC ACID

This is a continuation of application Ser. No. 948,211, filed Dec. 31, 1986.

BACKGROUND OF THE INVENTION

Field of the Invention

The present invention relates to a method for modifying the physical properties of bituminous materials and to compositions obtained therefrom. More particularly, the present invention relates to a method of producing industrial asphalts. Industrial asphalts have many uses but are particularly useful in roofing applications.

The physical properties of asphalt vary over a wide range. FIG. 1 is a softening point-penetration plot for various industrial asphalt grades. The four rectangles in FIG. 1 outline the properties of Types I–IV industrial asphalts as defined by the American Society for Testing and Materials (ASTM D 312). The plot of industrial asphalts for different applications. Industrial asphalts have softening points above 135° F.

The residue remaining from crude oil after distilling off the various cuts is known as asphalt, or is known as asphalt flux, or simply flux when it is used to make asphalt. Flux is treated in various ways to obtain industrial asphalts having a variety of uses.

The properties of bituminous materials may be modified by such well known treating means such as solvent extraction, air-blowing and the like. One type of treatment involves air-blowing, with or without a catalyst and with or without a hydrocarbon diluent.

Air-blowing processes using phosphoric acid and other catalysts are known in the art for making industrial asphalts. However, air-blowing processes require complex and expensive air-blowing equipment which must meet ever more stringent air pollution regulations. Furthermore, air-blowing requires long processing times on the order of hours. Similar products can sometimes be obtained by stirring asphalt at high temperature in the presence of a catalyst. One known catalyst is essentially pure phosphoric acid.

U.S. Pat. No. 3,751,278 discloses a process for treating asphalts without air-blowing using phosphoric acids having an $H_3PO_4$ equivalent of greater than 100 percent. The compositions produced by this process are directed to paving asphalts particularly useful in highway construction and maintenance. Paving asphalts usually have softening points below 135° F. and penetrations from 20 to 300 dmm at 77° F. This patented process is particularly directed to treating asphalts to substantially increase the viscosity without a significant decrease in penetration.

U.S. Pat. No. 2,179,208 teaches a process for making asphalt which comprises air-blowing in the absence of any catalyst at a temperature of 300° to 500° F. for 1 to 30 hours followed by a second step of heating that material to a temperature greater than 300° F. with a small amount of polymerizing catalysts. The catalysts include phosphoric acid, ferric chloride, $BF_3$, etc. Using small amounts of these catalysts, products with softening or melting points of 140° F. or less were produced. The patent teaches that overall processing times are significantly reduced using this two-step process.

U.S. Pat. No. 2,762,755 teaches a two-step process for producing asphalt which comprises the steps of: (1) treating asphalt with from 1/10 to 10 percent phosphoric acid at a temperature from about 200° F. to about 350° F. for a period of time from 4 hours to ½ hour followed by the second step (2) of oxidizing the product of step (1) at a temperature from about 350° F. to about 450° F. to obtain the desired characteristics for the product asphalt.

U.S. Pat. Nos. 2,676,910 and 2,845,359 teach the use of $P_2O_5$ with the exclusion of air in a process to modify asphalts. These patents are particularly directed at producing asphalts for canal linings or cutback asphalts.

U.S Pat. No. 1,092,448 teaches a method of treating mineral oil with phosphoric acid at a temperature of approximately 300° C. (572° F.) to produce purified oils.

U.S. Pat. No. 3,392,104 discloses an oxidative process for making asphalt from two crudes having different characteristics. At least one of the bottoms products from crude is produced in a solvent deasphalting process.

One object of the present invention is to produce an industrial asphalt using phosphoric acid that heretofore has not been produceable using phosphoric acid treatment.

Another object of the present invention is to provide a process which can utilize as a feed, bituminous materials which heretofore could not be used in making industrial asphalts by the prior art air-blowing processes without the addition of substantial amounts of lower boiling hydrocarbons.

Other objects will be readily apparent to those skilled in the art from a reading of this specification.

SUMMARY OF THE INVENTION

A method for modifying the physical properties of a bituminous material which comprises heating at an elevated temperature a mixture comprising:

(a) 0.1 to 20.0 percent by weight phosphoric acid;

(b) 1 to 15 percent by weight solvent deasphalted bottoms; and (c) a bituminous material to make up 100 percent by weight, said bituminous material comprising vacuum distilled asphalt.

DETAILED DESCRIPTION OF THE INVENTION

Figure 1:
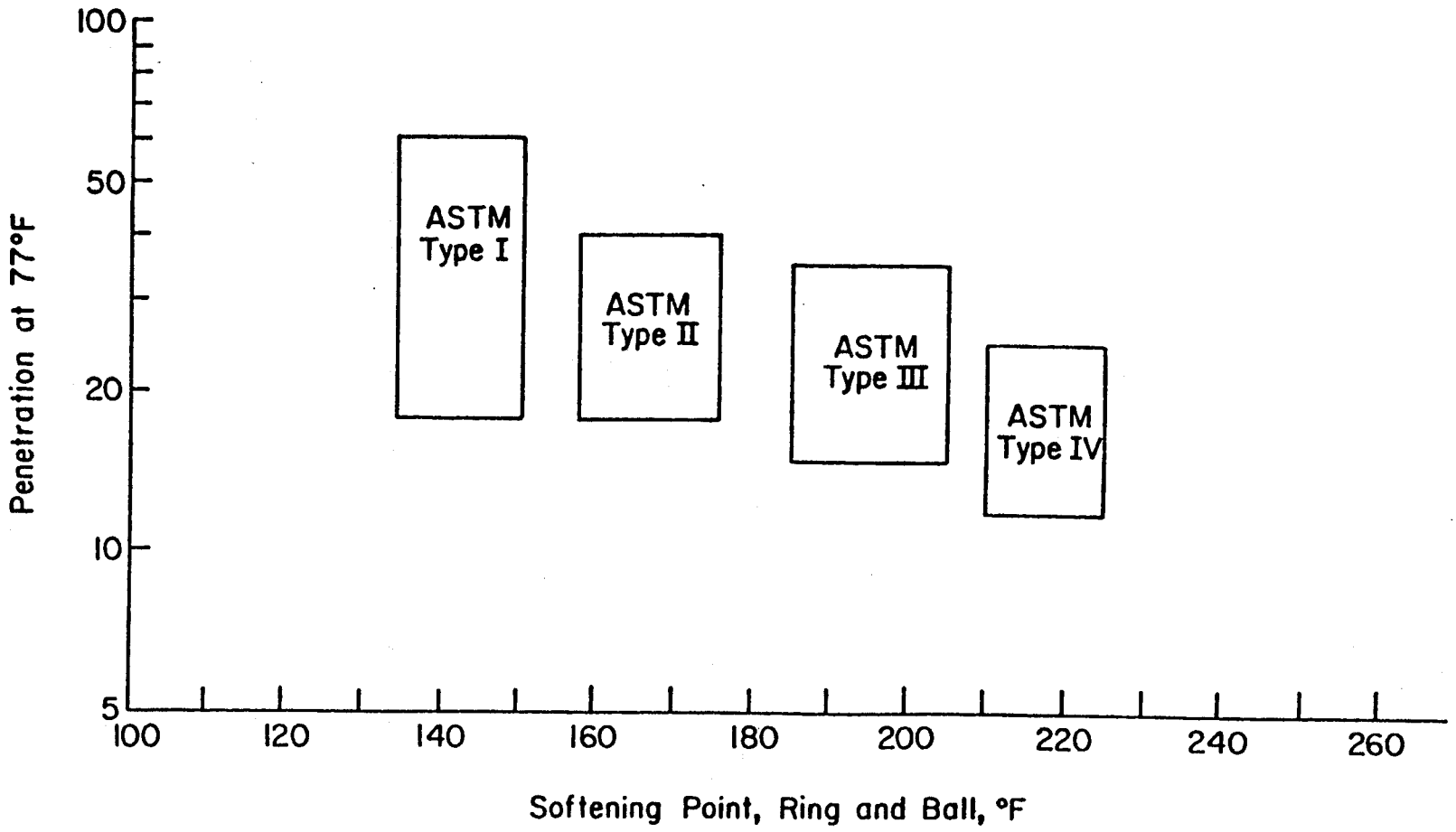

The product industrial asphalts of the present invention are prepared by heating at an elevated temperature a mixture comprising phosphoric acid, solvent deasphalted bottoms, and a bituminous material.

The Bituminous Materials

Bituminous materials for use in the present invention can be of varied character. See, for example, "Bituminous Materials: Asphalts, Tars, and Pitches" Vol. I, A. J. Hoiberg, Editor, 1964, Interscience, pages 2–5, the disclosure of which is incorporated herein by reference. Many petroleum residua (also known as fluxes) remaining after the separation of vaporizable hydrocarbons from oil fractions, or any relatively high molecular weight extracts obtained from petroleum refining or from naturally occurring hydrocarbons (including tar and Gilsonite) can be used.

Particularly preferred bituminous materials include: petroleum distillation residua (vacuum distilled asphalt); a blend of hard petroleum distillation residue, or a blend of Gilsonite. Any of the above blends can contain petroleum distillate or vegetable oil diluents. Generally the bituminous material will have a viscosity at 350° F. of at least 50 cSt. Particularly preferred are bituminous materials (particularly vacuum distilled asphalt) having softening points in the range 100 to 200° F., preferably 110° to 150° F. and penetrations in the range 30 to 150 dmm, preferably 55 to 100 dmm.

Particularly preferred bituminous materials for use in the process of the present invention are bituminous materials which become softer after 50 minutes of treatment with at least 8 pph by weight phosphoric acid (115%) at 500° F. Not all bituminous materials respond the same to phosphoric acid treatment and some become harder with treatment rather than softer. One particularly surprising feature of the present invention resides in the finding that for those bituminous materials that become softer with phosphoric acid treatment alone, the addition of solvent deasphalted bottoms results in the mixture becoming harder with phosphoric acid treatment.

Not included in the bituminous materials above is any solvent deasphalted bottoms which is described below.

Solvent Deasphalted Bottoms

Solvent deasphalting or treating processes are well known in the art. See for example U.S. Pat. No. 3,392,104, the entire disclosure of which is incorporated herein by reference. The object in solvent treating is to remove asphaltenes and also to reduce the concentration of heteroorganic compounds of nitrogen, sulfur, oxygen, and metals contained in a residuum. In such processes the asphaltic constituents from a residuum is treated with a solvent producing a fraction which is soluble in the solvent and a fraction which is not soluble in the solvent. The solvent soluble fraction is generally substantially a nonasphaltic residuum. The fraction which is not soluble in the solvent is the asphaltic portion of the residuum, and is known as solvent deasphalted ("SDA") bottoms or tar. It contains most of the asphaltenes, resins, and metal compounds. Typical solvents used in solvent deasphalting processes include light hydrocarbons such as propane and mixtures of propane and butane. The composition of solvent deasphalted bottoms is very complex and cannot be defined by structural formulas. However, solvent deasphalted bottoms can be characterized as having a hydrogen/carbon ratio of less than 1.25, a metals content greater than 500 ppm, and a softening point greater than 140° F. As used herein "metals" includes vanadium, nickel and iron.

Phosphoric Acid

Phosphoric acid is well known in the art and is readily available commercially. Phosphoric acid is available in concentrations up to about 115%. Most preferred for use in the present invention are phosphoric acids having an $H_3PO_4$ equivalent in the range of 52 to 94% and more preferably 72 to 86%. Most preferred is the so called green phosphoric acid which is made from the digestion of phosphate rock with sulfuric acid. Green phosphoric acid is made by the well known wet process which is described in Kirk-Othmer, "Encyclopedia of Chemical Technology," Vol. 17 (1982), pages 435–437, the disclosure of which is incorporated herein by reference.

Processing Conditions

The amount of solvent deasphalted bottoms to be added to the bituminous material is in the range of 1 to 15 weight percent, preferably from 2 to 10 weight percent and most preferably 3 to 5 weight percent based on the bituminous material. The higher ranges of solvent deasphalted bottoms are utilized with the softer bituminous materials and the lower ranges with harder bituminous materials. The amount of phosphoric acid used in the treatment varies from 0.1 to 20 weight percent, preferably from 0.5 to 10 weight percent and most preferably 1 to 5 weight percent based on bituminous material. Less acid is used with the higher concentrations of solvent deasphalted bottoms and more acid is used with lower concentrations of solvent deasphalted bottoms. Preferably, the quantity of solvent deasphalted bottoms plus phosphoric acid ranges from 1 to 10 weight percent and more preferably 2 to 5 weight percent. Sufficient bituminous material is used in all instances to make up 100 percent by weight.

Other additives and other components may be present in the mixture. These additional components can be added to the mixture either before, during or after the treatment at the elevated temperature. One well known additional component is a lower boiling hydrocarbon particularly a lower boiling crude oil distillate boiling in the range of 500° to 1200° F. and preferably 680° to 1050° F. One such component is commonly known as gas oil. Generally such lower boiling hydrocarbons will be present in the range of 1 to 10 weight percent, and preferably 2 to 6 weight percent based on the weight of the bituminous material. The lower boiling hydrocarbon additive is sometimes referred to as a fluxing oil in the asphalt art.

The treating method of the present invention comprises heating the bituminous material to a temperature in the range 200° F. to 800° F., preferably 350° F. to 550° F. This heating facilitates mixing and reacting of the bituminous material with the phosphoric acid and the solvent deasphalted bottoms.

After the bituminous material has been heated to a temperature sufficient for mixing purposes, at least above its softening point, the phosphoric acid and solvent deasphalted bottoms is most often introduced into the hot feed with continuous agitation. Agitation is usually supplied by mechanical means and must be adequate to disperse the phosphoric acid and solvent deasphalted bottoms throughout the asphalt. A preferred alternative process for mixing involves the use of in-line blending and a static mixer which further facilitate very short mixing and reaction time.

The acid treatment process of the present invention requires from 1 to 1000 minutes or more. Longer process times can also be utilized but are not necessary and are less economical. Preferably, the acid treatment time ranges from 10 to 100 minutes. Not included in the treatment time is the time required to initially heat the bituminous material to treatment temperature.

Preferably, the product industrial asphalts of the present invention are formed in a one-step process without any air-blowing or other oxidation treatment of the starting material prior to or after blending with the phosphoric acid and solvent deasphalted bottoms.

More preferably the present method of treating bituminous materials does not include air-blowing of the feed stock during mixing or as a part of the treatment, the treatment being carried out without passing air through the material either before, during or after treatment as is done in conventional prior art processes.

In the process of the present invention the physical properties of the bituminous material are modified.

Generally the softening point of the bituminous material is substantially increased and the penetration is significantly decreased. The amount of increase in the softening point and decrease in penetration will vary greatly depending upon the properties of the feed and the amounts of phosphoric acid and solvent deasphalted bottoms used and the mixing temperature. Generally, it is desired to substantially increase the softening point by 50° F. to 120° F., preferably by 70° F. to 100° F. and significantly lower the penetration at 77° F. by 20 to 80 dmm, preferably by 30 to 60 dmm.

The Product Asphalts

The product industrial asphalts of the present invention will preferably have a softening point of 130° to 245° F., preferably 200° to 240° F., and more still more preferably 215° F. to 230° F. with a penetration at 77° F. from 10 to 70 dmm, preferably 12 to 40 dmm and still more preferably 16 to 26 dmm.

EXEMPLIFICATION

To further describe and to exemplify the present invention, the following examples are presented. These examples are in no manner to be construed as limiting the present invention.

EXAMPLES

In the following examples the viscosity was determined using ASTM D 2170, the penetration by ASTM D 5, and softening point by ASTM D 2398.

The amounts of bituminous material, SDA (solvent deasphalted) bottoms, fluxing oil, phosphoric acid, reaction time and the properties of the product are given in Table I below. All reaction temperatures were at 500° F.

TABLE 1

| Example | Bituminous Material, Wt %[4] | SDA Bottoms, Wt %[4] | Fluxing Oil, Wt %[4] | $H_3PO_4$ pph[5] | Reaction Time, Min. 25 SP, °F. | 25 Pen, dmm[3] | 50 SP, °F. | 50 Pen, dmm[3] | 75 SP, °F. | 75 Pen, dmm[3] | 100 SP, °F. | 100 Pen, dmm[3] |
|---|---|---|---|---|---|---|---|---|---|---|---|---|
| 1 | 95[1] | — | 5 | 4.5 | 212 | 19 | 217 | 19 | 227 | 16 | — | — |
| 2 | 90[1] | — | 10 | 8 | 230 | 18 | 237 | 17 | 245 | 14 | — | — |
| 3 | 90[2] | — | 10 | 8 | 207 | 25 | 198 | 23 | 179 | 27 | 183 | 39 |
| 4 | 93[2] | 4.0 | 3 | 6 | 210 | 20 | 212 | 19 | 215 | 18 | — | — |
| 5 | 93[2] | 4.5 | 2.5 | 5 | 205 | 20 | 209 | 19 | 215 | 18 | — | — |

[1]Santa Maria Crude residuum. The residuum had a softening point of 124° F. and a penetration of 58 dmm at 77° F.
[2]Alaskan North Slope Crude residuum. The residuum had a softening point of 116° F. and a penetration of 86 dmm at 77° F.
[3]At 77° F.
[4]Weight percent includes the total weight of bituminous material, SDA, and fluxing oil.
[5]Parts per hundred includes the total weight of bituminous material, SDA, fluxing oil, and Water White (115%) $H_3PO_4$.

Examples 1 and 2 in the above table show the results with a bituminous material that has an increase in hardness upon treatment with phosphoric acid alone. Example 3 shows the result with a bituminous material that has a decrease in hardness upon treatment with phosphoric acid alone. Examples 4 and 5 show the results of adding solvent deasphalted bottoms to the bituminous material of Example 3. Surprisingly phosphoric acid treatment of the bituminous material with solvent deasphalted bottoms added results in an increase in hardness. This occurs although less phosphoric acid is being utilized than in the examples without solvent deasphalted bottoms added.

What is claimed is:

1. A method for modifying the physical properties of a bituminous material whereby the softening point of said bituminous material is increased by 50° to 120° F. and its penetration is decreased by 20 to 80 dmm which comprises heating at an elevated temperature a mixture comprising:

(a) 0.1 to 20.0 percent by weight phosphoric acid;
(b) 1 to 15 percent by weight solvent deasphalted bottoms; and
(c) said bituminous material to make up 100 percent by weight, said bituminous material consisting essentially of vacuum distilled asphalt free of solvent deasphalted bottoms, thereby producing an industrial asphalt having a softening point in the range of 200° F. to 240° F. and a penetration in the range of 12 to 44 dmm at 77° F.

2. The method of claim 1 wherein said elevated temperature is in the range 200° to 800° F. and said mixture comprises:

(a) 0.5 to 10.0 percent by weight phosphoric acid;
(b) 2 to 10 percent by weight solvent deasphalted bottoms; and
(c) a bituminous material to make up 100 percent by weight, said bituminous material comprising vacuum distilled asphalt.

3. The method of claim 2 wherein said elevated temperature is in the range of 350° to 550° F.

4. The method of claim 3 wherein the softening point of said bituminous material is increased by 70° F. to 100° F. and the penetration is decreased by 30 to 60 dmm.

5. The method of claim 4 wherein said heating of said mixture is carried out in 10 to 1000 minutes.

6. The method of claim 5 wherein the amount of phosphoric acid is in the range of 1 to 5 percent by weight and the amount of solvent deasphalted bottoms is in the range 3 to 5 weight percent.

7. The method of claim 5 wherein the resulting product in an industrial asphalt having a softening point in the range of 200° to 235° F. and a penetration in the range 12 to 30 dmm at 77° F.

8. A one-step method of producing an industrial asphalt from vacuum distilled asphalt whereby the softening point of said vacuum distilled asphalt is increased by 50° to 120° F., and its penetration is decreased by 20 to 80 dmm which comprises heating at an elevated temperature a mixture comprising:

(b) 1 to 5 percent by weight green phosphoric acid;
(b) 3 to 5 percent by weight solvent deasphalted bottoms; and
(c) vacuum distilled asphalt to make up 100 percent, said vacuum distilled asphalt consisting essentially of vacuum distilled asphalt free of solvent deasphalted bottoms having a softening point in the range 110° to 150° F. and a penetration in the range 55 to 100 dmm, thereby producing an industrial asphalt having a softening point in the range of 200° to 240° F. and a penetration in the range of 12 to 40 dmm at 77° F.

9. The method of claim 8 wherein said mixture also contains 2 to 6 weight percent of a petroleum distillate boiling in the range 850° to 1050° F.

* * * * *